US009139397B2

(12) United States Patent
Sato et al.

(10) Patent No.: US 9,139,397 B2
(45) Date of Patent: Sep. 22, 2015

(54) SHEET BINDING PROCESSING APPARATUS AND IMAGE FORMING SYSTEM

(71) Applicant: CANON KABUSHIKI KAISHA, Tokyo (JP)

(72) Inventors: Kazumi Sato, Kashiwa (JP); Toshifumi Kakutani, Abiko (JP); Takeyuki Suda, Nagareyama (JP); Yousuke Hata, Ichikawa (JP); Hirohisa Kato, Toride (JP); Shinya Suzuki, Toride (JP); Yoshitaka Yamazaki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/259,222

(22) Filed: Apr. 23, 2014

(65) Prior Publication Data

US 2014/0334901 A1 Nov. 13, 2014

(30) Foreign Application Priority Data

May 9, 2013 (JP) ..... 2013-099202

(51) Int. Cl.

| | |
|---|---|
| ***B65H 43/02*** | (2006.01) |
| ***B42B 9/00*** | (2006.01) |
| ***B65H 37/04*** | (2006.01) |
| ***B31F 5/00*** | (2006.01) |

(52) U.S. Cl.

CPC ..... *B65H 43/02* (2013.01); *B31F 5/001* (2013.01); *B42B 9/00* (2013.01); *B65H 37/04* (2013.01); *B65H 2801/27* (2013.01)

(58) Field of Classification Search

CPC ..... B42B 9/00; B65H 43/02; B65H 37/04; B65H 2801/27; B31F 5/001

USPC ..... 270/58.02, 58.08, 58.09; 412/11, 12

See application file for complete search history.

(56) References Cited

U.S. PATENT DOCUMENTS

| | | | | |
|---|---|---|---|---|
| 4,878,656 | A * | 11/1989 | Honjo et al. | 270/58.09 |
| 4,917,366 | A * | 4/1990 | Murakami et al. | 270/58.09 |
| 5,447,297 | A * | 9/1995 | Murata et al. | 270/58.09 |
| 5,640,232 | A * | 6/1997 | Miyake et al. | 399/18 |
| 6,948,224 | B2 * | 9/2005 | Coombs et al. | 29/407.01 |
| 7,055,815 | B2 | 6/2006 | Sato et al. | |
| 7,134,659 | B2 | 11/2006 | Sato et al. | |
| 7,407,156 | B2 * | 8/2008 | Iizuka et al. | 270/58.11 |
| 8,226,079 | B2 * | 7/2012 | Ozawa | 270/58.09 |
| 8,246,034 | B2 * | 8/2012 | Tsuchiya | 270/58.12 |
| 8,382,090 | B2 * | 2/2013 | Sasamoto et al. | 270/58.07 |
| 8,991,809 | B2 * | 3/2015 | Tanonaka | 270/58.09 |
| 2006/0214347 | A1 * | 9/2006 | Iizuka et al. | 270/58.14 |
| 2011/0031677 | A1 * | 2/2011 | Ozawa | 270/58.12 |
| 2012/0082497 | A1 * | 4/2012 | Nagasaki | 399/410 |
| 2014/0151950 | A1 * | 6/2014 | Hata et al. | 270/58.11 |
| 2015/0014386 | A1 * | 1/2015 | Obuchi et al. | 227/100 |
| 2015/0021145 | A1 * | 1/2015 | Sekigawa et al. | 198/602 |
| 2015/0021374 | A1 * | 1/2015 | Kubo et al. | 227/39 |
| 2015/0048137 | A1 * | 2/2015 | Misumi et al. | 227/19 |

* cited by examiner

*Primary Examiner* — Leslie A Nicholson, III

(74) *Attorney, Agent, or Firm* — Fitzpatrick, Cella, Harper & Scinto

(57) ABSTRACT

A sheet binding processing apparatus for avoiding the residual of binding member is provided. The sheet binding processing apparatus comprises a sheet insertion port through which a sheet bundle formed of a plurality of sheets S is inserted, a movable stapler for binding the sheet bundle inserted through the sheet insertion port, and a manual stapling sheet sensor for detecting, at a predetermined detection time interval, existence or non-existence of the sheet bundle in the sheet insertion port. When the manual stapling sheet sensor detects the existence of the sheet bundle, the sheet binding processing apparatus gives permission to bind the sheet bundle by the movable stapler.

16 Claims, 6 Drawing Sheets

【E*** STAPLE NEEDLE REMAINING ERROR】

STAPLE NEEDLE IS REMAINING AROUND STAPLE. PLEASE REMOVE.

【E*** STAPLING NOT PERFORMED ERROR】

DETERMINED NON-EXISTENCE OF PAPER AFTER DEPRESSION OF STAPLE BUTTON. SO, STOPPED STAPLING.

SHEET BINDING PROCESSING APPARATUS AND IMAGE FORMING SYSTEM

BACKGROUND OF THE INVENTION

1. Field of the Invention

The present invention generally relates to an image forming system comprising an image forming apparatus for forming an image on sheet such as paper, and a post-processing apparatus for performing post-processing on the sheet having the image formed thereon. More particularly, the present invention relates to a technology for binding a sheet bundle formed of a plurality of sheets having an image formed thereon.

2. Description of the Related Art

Image forming systems may include a post-processing apparatus for performing various kinds of post-processing on a sheet having an image formed thereon by an image forming apparatus. As this type of post-processing apparatus, for example, there is known a sheet binding processing apparatus including a stapler for binding a sheet bundle formed of a plurality of sheets through a use of a binding member such as a metal staple.

In a sheet binding processing apparatus, generally, the sheet bundle delivered from the image forming apparatus is automatically bound by the stapler ("automatic stapling"). On the other hand, there is a demand to bind the sheet bundle through a manual operation by a user ("manual stapling") instead of the automatic stapling.

To meet the users' demand as described above, U.S. Pat. No. 7,407,156 discloses such a technology that the user manually inserts the sheet bundle through a delivery port of the post-processing apparatus, to thereby bind the sheet bundle with the stapler.

When the manual stapling as described above is performed, however, binding process may be performed in a state that the sheet bundle is not arranged in a correct binding position. In that case, the binding member which has failed to bind the sheet bundle in a correct manner may remain in the sheet binding processing apparatus. The binding member having remained in the sheet binding processing apparatus may be pushed into the sheet binding processing apparatus along with the sheet bundle at the next binding process, which may be a cause of the breakdown of the sheet binding processing apparatus.

SUMMARY OF THE INVENTION

The sheet binding processing apparatus of the present disclosure comprises a sheet insertion port through which a sheet bundle formed of a plurality of sheets is inserted; a binding unit configured to bind the sheet bundle inserted through the sheet insertion port; a detection unit configured to detect, at a predetermined detection time interval, an existence or non-existence of the sheet bundle in the sheet insertion port; and a control unit configured to stop, in a case where the non-existence of the sheet bundle is detected by the detection unit after the detection of the existence of the sheet bundle by the detection unit and before the binding of the sheet bundle by the binding unit, the operation of the binding unit without completing the binding process performed by the binding unit.

Further features of the present invention will become apparent from the following description of exemplary embodiments (with reference to the attached drawings).

DESCRIPTION OF THE EMBODIMENTS

Various exemplary embodiments, features, and aspects of the present disclosure are described below in detail with reference to the drawings.

Figure 1:
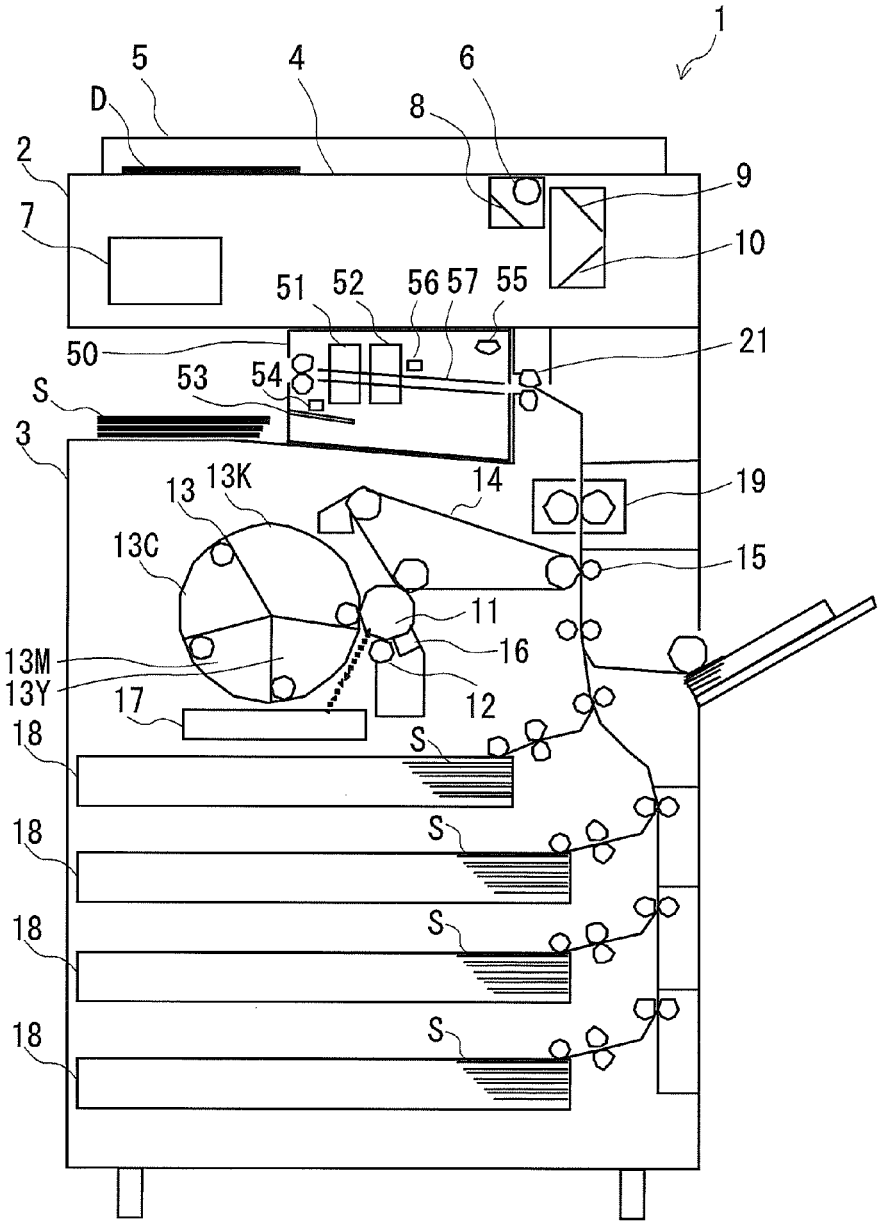
FIG. 1 is a diagram of an overall structure of an image forming system.

FIG. 1 is a diagram of an overall structure of an image forming system of a present embodiment. The image forming system includes an image forming apparatus 1 and a sheet binding processing apparatus 50. The sheet binding processing apparatus 50 is an example of a post-processing apparatus for performing post-processing on a sheet having an image formed thereon received from the image forming apparatus 1. In relation to the sheet binding processing apparatus 50, the image forming apparatus 1 is an example of an external apparatus connected to the sheet binding processing apparatus 50 so as to be capable of feeding a sheet.

<Configuration of Image Forming Apparatus>

The image forming apparatus 1 includes an image reading section 2 for reading an image of an original, and an image forming section 3 for forming the image on a sheet S. Further, a toner that is an example of a developer is used as a color material for image formation.

A document table 4 formed of a transparent glass plate is provided at an upper portion of the image reading section 2. A user places an original D at a predetermined position on the document table 4 with its image surface oriented downward, and then presses and fixes the original D with a document pressing plate 5. An optical system is provided on a lower side of the document table 4. The optical system includes a lamp 6 for illuminating the original D, and reflection mirror 8, 9, and 10 for guiding an optical image of the illuminated original D to an image sensor of the image processing unit 7. The lamp 6 and the reflection mirrors 8, 9, and 10 move at a predetermined speed to scan the original D.

The image forming section 3 includes a photosensitive drum 11, a primary charging roller 12, a rotary developing unit 13, an intermediate transfer belt 14, a transfer roller 15, a cleaner 16, a laser unit 17, sheet cassettes 18, a fixing device 19, and a delivery roller pair 21.

The primary charging roller 12 uniformly charges a surface of the photosensitive drum 11 before laser light irradiation. Based on image data, the laser unit 17 irradiates the charged surface of the photosensitive drum 11 with the optical image. This forms electrostatic latent images on the photosensitive drum 11. The rotary developing unit 13 adheres magenta, cyan, yellow, and black toners to the electrostatic latent images formed on the surface of the photosensitive drum 11 to form toner images.

The rotary developing unit 13 employs a rotary developing system, and includes a developing device 13K, 13Y, 13M, and 13C, and is rotatable by a motor (not shown). The developing device 13K, the developing device 13Y, the developing device 13M, and the developing device 13C are used for developing a black toner image, a yellow toner image, a magenta toner image, and a cyan toner image, respectively.

When forming a monochrome toner image on the photosensitive drum 11, the developing device 13K is moved through rotation to a developing position that is proximate to the photosensitive drum 11, to thereby develop the toner image. Similarly, when forming a full-color toner image, each of the developing devices 13Y to 13K is arranged at the developing position through the rotation of the rotary developing unit 13, to thereby develop the toner image of the corresponding color.

The toner images developed on the surface of the photosensitive drum 11 are transferred onto the intermediate transfer belt 14. The cleaner 16 removes the toners remaining on the photosensitive drum 11 after the toner images are transferred. The toner images on the intermediate transfer belt 14 are transferred by the transfer roller 15 onto the sheet S that is fed from one of the sheet cassettes 18. The fixing device 19 heats and pressurizes the conveyed sheet S to fix the toner images on the sheet S. The sheet S having the toner images fixed thereon by the fixing device 19 is delivered from the image forming apparatus 1 by the delivery roller pair 21 to the sheet binding processing apparatus 50 that is installed on a downstream side of the image forming apparatus 1.

<Configuration of Sheet Binding Processing Apparatus>

The sheet binding processing apparatus 50 is provided at a position at which the sheet S is delivered from the image forming apparatus 1. The sheet binding processing apparatus 50 includes a binding mechanism for binding a sheet bundle formed of a plurality of the sheets S, a shifting mechanism for moving the binding mechanism, and a control mechanism for controlling the shifting mechanism. The sheet binding processing apparatus 50 and the image forming apparatus 1 communicate to and from each other via a signal line (not shown), to thereby mutually monitor the states thereof and operate in cooperation.

The sheet binding processing apparatus 50 includes a movable stapler 51, an eco-stapler 52, a manual stapling sheet insertion port 53, a manual stapling sheet sensor 54, a manual stapling execution button 55, a sheet detection sensor 56, and a sheet alignment section 57. The movable stapler 51 is a stapler that shifts (moves) its position by the above-mentioned shifting mechanism.

When the sheet detection sensor 56 for detecting an existence or non-existence of the sheets S detects the delivery of all the sheets S forming a sheet bundle to the sheet alignment section 57, the movable stapler 51 and the eco-stapler 52 performs a binding process in accordance with a binding mode set by the user.

The movable stapler 51 performs the binding process through use of a metal staple, which is one example of binding member. The eco-stapler 52 includes an upper tooth portion and a lower tooth portion that are engageable with each other. The eco-stapler 52 sandwiches and pressurizes the sheet bundle between the upper tooth portion and the lower tooth portion, which enables to perform the binding process with no use of the binding member.

The manual stapling sheet insertion port 53 is provided so that the user manually inserts the sheet bundle therethrough. The manual stapling sheet sensor 54 detects the existence or non-existence of the sheet bundle inserted through the manual stapling sheet insertion port 53. When the manual stapling sheet sensor 54 detects the existence of the sheet bundle, the manual stapling execution button 55 is brought into a depressible (pushable) state. When the user depresses the manual stapling execution button 55, the movable stapler 51 performs the binding process to the sheet bundle inserted through the manual stapling sheet insertion port 53.

<Details of Movable Stapler>

Now, the movable stapler 51 is described in detail.

Figure 2:
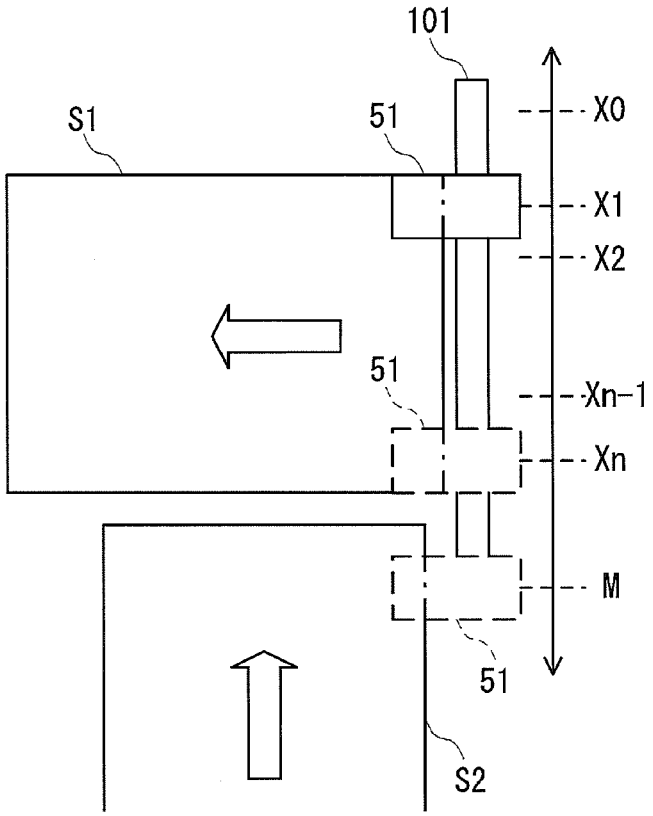
FIG. 2 is a diagram illustrating a movable stapler.

FIG. 2 is a sectional view illustrating the sheet binding processing apparatus 50 as seen from the top. The lower side of FIG. 2 corresponds to a front surface side of the image forming apparatus 1 illustrated in FIG. 1. The movable stapler 51 takes two roles. Firstly, a role as an automatic stapler for automatically performing the binding process to the sheet bundle of sheet S1 delivered from the image forming apparatus 1 at a preset position. Secondly, a role as a manual stapler for manually performing the binding process to the sheet bundle of sheet S2 inserted, by the user, through the manual stapling sheet insertion port 53.

When the movable stapler 51 is used as an automatic stapler, the movable stapler 51 moves along a movement guide 101 under the control of the shifting mechanism, and performs the binding process at an arbitrary position selected from among positions X1 to Xn set by the user. Note that, the number of the positions X1 to Xn available to set differs depending on product specifications of the sheet binding processing apparatus 50.

When the movable stapler 51 is used as a manual stapler, the movable stapler 51 performs the binding process at a position M. The manual stapling sheet insertion port 53 is provided on the front surface side of the sheet binding processing apparatus 50 (image forming apparatus 1). Therefore, when the movable stapler 51 performs the binding process through the manual stapling, the movable stapler 51 is moved to the position M in accordance with the control of the shifting mechanism. Note that, when the movable stapler 51 performs no binding process, the movable stapler 51 stands by at the position x0 or at the position M.

<Arrangement of Manual Stapling Sheet Sensor>

Figure 3:
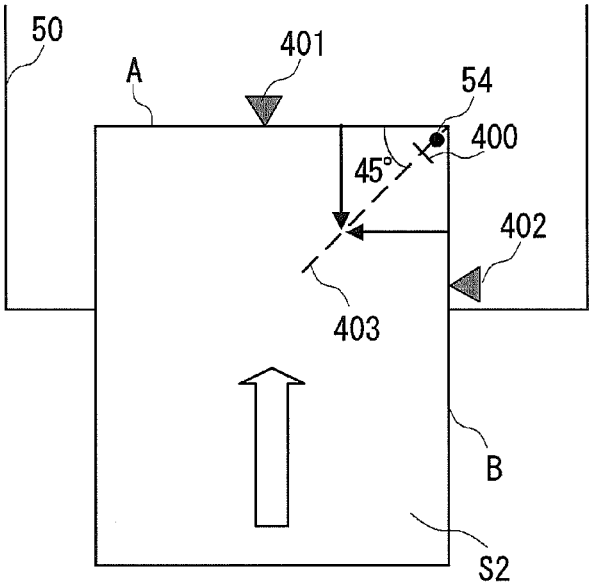
FIG. 3 is a diagram illustrating an arrangement of manual stapling sheet sensor.

FIG. 3 is a diagram illustrating an arrangement of manual stapling sheet sensor 54. FIG. 3 is a sectional view illustrating the sheet binding processing apparatus 50 as seen from the top. The lower side of FIG. 3 corresponds to a front surface side of the image forming apparatus 1 illustrated in FIG. 1.

The sheet S2 inserted through the manual stapling sheet insertion port 53 for manual stapling is positioned such that it comes into contact with an abutment member 401 for a side A of the sheet S2 and an abutment member 402 for a side B which is perpendicular to the side A. The movable stapler 51 performs the binding process to the sheet bundle positioned here through the manual stapling.

Therefore, the manual stapling sheet sensor 54 is arranged in a direction to which the sheet S2 is movable and at a position at which an existence or non-existence of the sheet S2 is detectable without fail. For example, in FIG. 3, the manual stapling sheet sensor 54 is arranged at equal distance from two sides, the side A and the side B of the sheets S2. As a result, the manual stapling sheet sensor 54 is arranged at a sheet detecting position 403 which is on a line forming an angle of 45 degrees to both the side A and the side B, which enables to detect the sheet S2 even in a case where the sheet S2 is moved in a direction parallel to the side A or the side B.

<Function of Entire Image Forming System>

Figure 4:
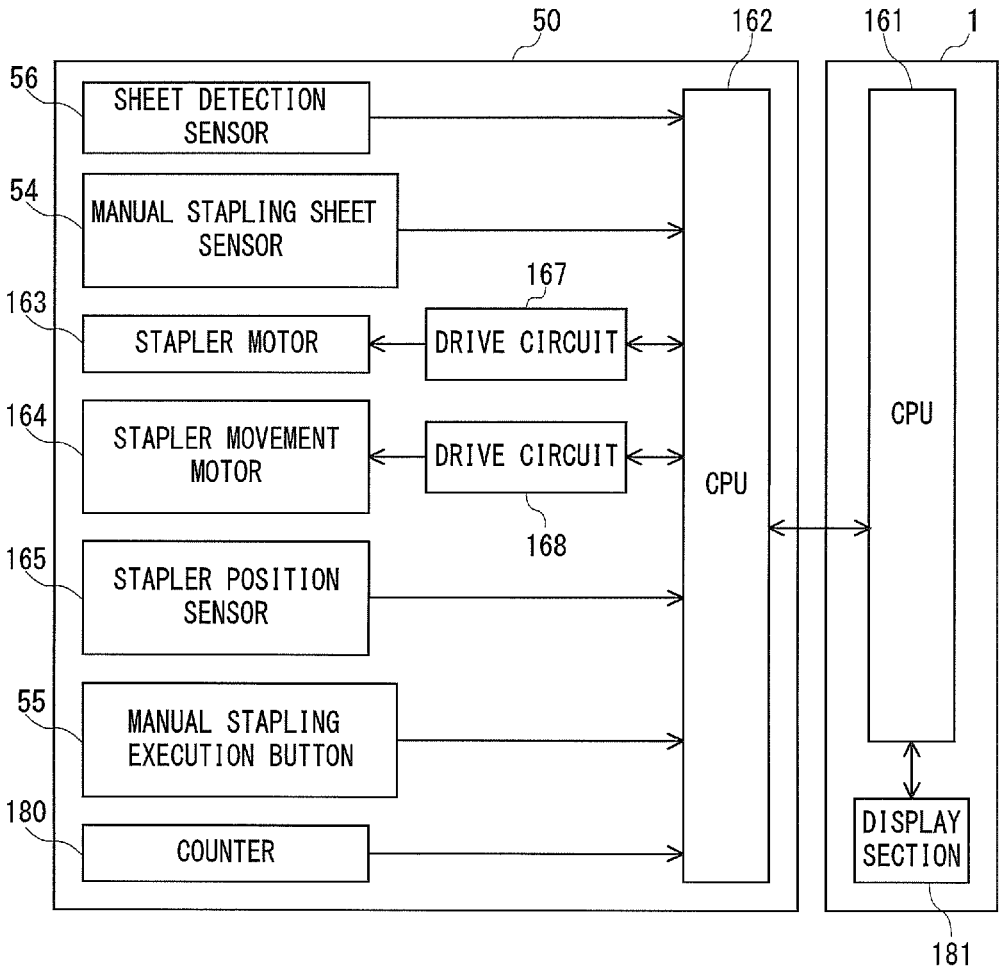
FIG. 4 is a configuration diagram of a control device of the image forming system.

FIG. 4 is a configuration diagram of a control device of the image forming system.

The sheet binding processing apparatus 50 is mainly controlled by a central processing unit (CPU) 162. The CPU 162 communicates to and from a control device for controlling the image forming apparatus 1, for example, a CPU 161, to thereby mutually detect (or determine) the operation states thereof.

The sheet detection sensor 56 detects the existence or non-existence of the sheet S in the sheet alignment section 57 (see FIG. 1), and notifies the CPU 162 of the detection result. The manual stapling sheet sensor 54 detects the existence or non-existence of the sheet S in the manual stapling sheet insertion port 53 (see FIG. 1), and notifies the CPU 162 of the detection result. A stapler motor 163 is provided inside the movable stapler 51 (see FIG. 1), and drives the movable stapler 51 to bind the sheet bundle with the metal staple. A drive circuit 167 controls the stapler motor 163. A stapler movement motor 164 is a stepping motor, and moves the movable stapler 51 to an arbitrary position of the movement guide 101 by changing the number of drive pulses in accordance with the distance detected by the stapler position sensor 165. A drive circuit 168 controls the stapler movement motor 164. The manual stapling execution button 55 notifies the CPU 162 of its depression. When the manual stapling execution button 55 is depressed, instruction to perform the binding process to the sheet bundle through the manual stapling is input into the CPU 162. A counter 180 measures time after the depression of the manual stapling execution button 55 and notifies the CPU 162 of the count value.

A display section 181 of the image forming apparatus 1 displays an error message notified from the CPU 161 or the CPU 162 to inform the user of the error.

<Binding Process Operation Through Manual Stapling>

Figure 5:
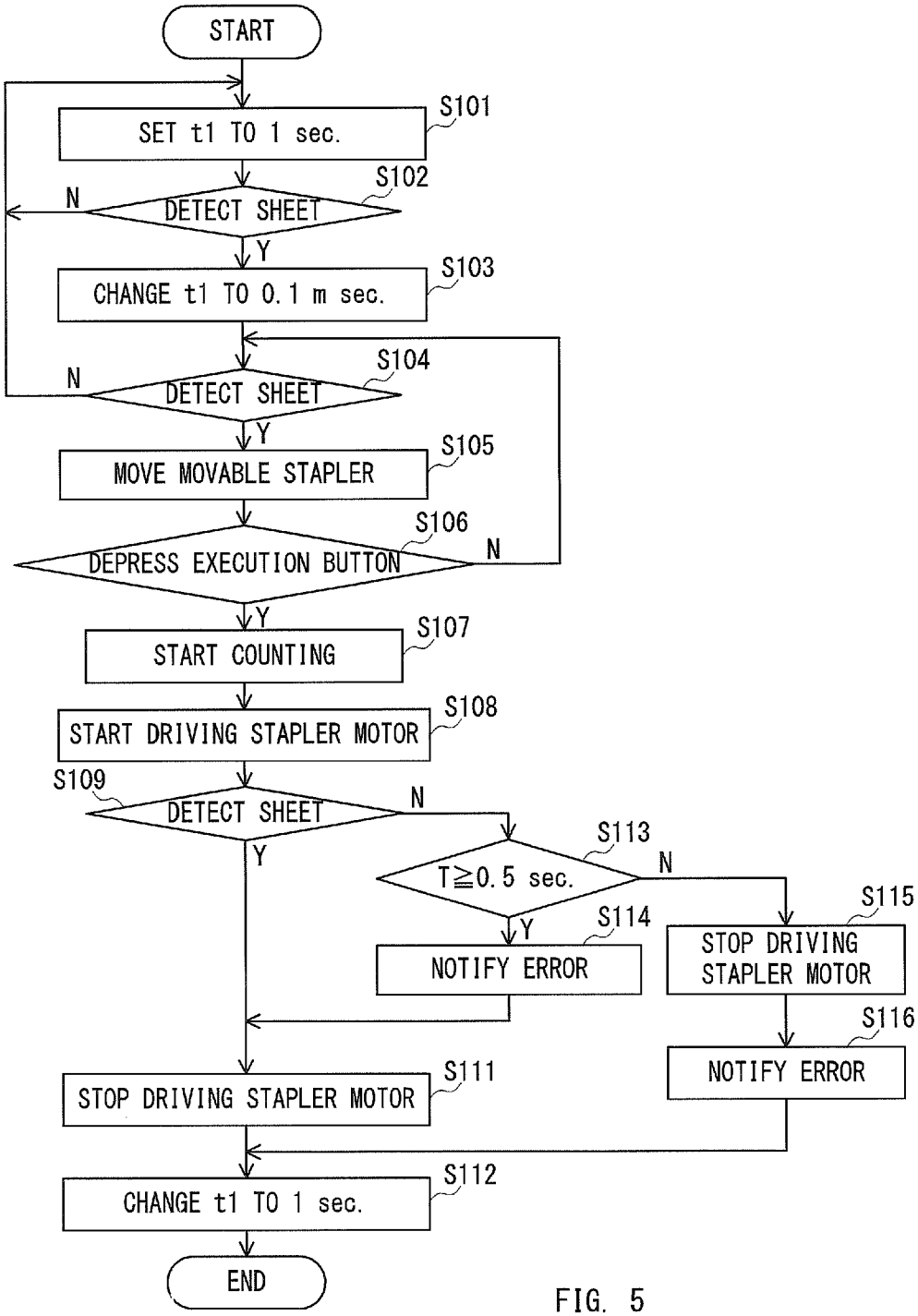
FIG. 5 is a flowchart illustrating controlling procedures of sheet binding processing apparatus when manual stapling is performed.

The sheet binding processing apparatus 50 when manual stapling is performed is controlled, for example, by procedures illustrated in the flowchart of FIG. 5.

The manual stapling sheet sensor 54 detects the insertion of the sheet bundle through the manual stapling sheet insertion port 53. To this end, the CPU 162 of the sheet binding processing apparatus 50 first sets a detection time interval t1, which is the time interval to detect the existence or non-existence of the sheet bundle by the manual stapling sheet sensor 54. The detection time interval t1 is set to 1 second (S101). The CPU 162 repeatedly performs the step S101 until the manual stapling sheet sensor 54 detects the existence of the sheet bundle (sheet bundle, exist) (S102: N, S101).

The CPU 162 determines, based on the detection of the existence of the sheet by the manual stapling sheet sensor 54, that the sheet bundle has been inserted through the manual stapling sheet insertion port 53. Then, the CPU 162 starts the binding process through the manual stapling.

When starting the binding process through the manual stapling, the CPU 162 first changes the setup detection time interval t1 set to the manual stapling sheet sensor 54 to the time interval shorter than the setup detection time interval (S102: Y, S103). In this embodiment, the detection time interval t1 is changed to 0.1 milliseconds.

Through the detection of the existence of the sheet bundle by the manual stapling sheet sensor 54, the CPU 162 starts the binding process through the manual stapling. To reduce the work load of the CPU 162, the detection time interval t1 is set to 1 second before starting the binding process. Starting the binding process through the manual stapling after the detection of the existence of the sheet bundle, the CPU 162 sets the detection time interval t1 to the time interval shorter than the setup detection time interval. Detecting the existence or non-existence of the sheet bundle at a detection time interval shorter than that before the insertion of the sheet bundle enables to immediately detect the exhaustion of the sheet bundle in the manual stapling sheet insertion port 53 for some reasons (such as falling down of the sheet bundle, redo stapling).

For example, in a case where the sheet bundle moves from within the detection range of the manual stapling sheet sensor 54 to out of the detection range of the manual stapling sheet sensor 54 at the movement speed of 1000 [mm/s] with the movement distance of 1 [mm], the movement time is 1 millisecond. Therefore, it is necessary to set the detection time interval t1 to less than or equal to 1 millisecond. In this embodiment, as one example, the detection time interval t1 is set to 0.1 millisecond. Through the optimization of the computing load of the CPU 162, this detection time interval gives no effect to the capacity of the image forming apparatus 1.

When the manual stapling sheet sensor 54 detects the non-existence of the sheet bundle (sheet bundle, non-exist) after changing the detection time interval t1, the CPU 162 goes back to step S101 and sets the detection time interval t1 to 1 second (S104: N, S101).

In a case where the manual stapling sheet sensor 54 detects the existence of the sheet bundle even after changing the detection time interval t1 to 0.1 millisecond, the CPU drives the stapler movement motor 164 until the movable stapler 51 moves to the position M, where the movable stapler 51 performs binding process through the manual stapling (S105). The CPU 162 activates the operation of the manual stapling execution button 55 and turns on a standby state of the notification from the manual stapling execution button 55 notifying its depression.

The CPU 162 repeatedly performs the detection of the existence or non-existence of the sheet bundle by the manual stapling sheet sensor 54 until the manual stapling execution button is depressed (S106: N, S104).

When the manual stapling execution button 55 is depressed, the CPU 162 zero-clears the count value T of the counter 180 to start counting (S107). With the start of the counting, the CPU 162 starts to drive the stapler motor 163 to perform the binding process (S108).

After the start of the drive of the stapler motor 163, in a case where the manual stapling sheet sensor 54 detects the existence of the sheet bundle (S109: Y), the CPU 162 continues the binding process through the manual stapling. After driving the stapler motor 163 for a predetermined time necessary for the binding process, the CPU 162 stops to drive the stapler motor 163 (S111). Then, the CPU 162 changes the detection time interval t1 to 1 second (S112). Then, the binding process through the manual stapling is ended.

Figures 6A, 6B, 7:
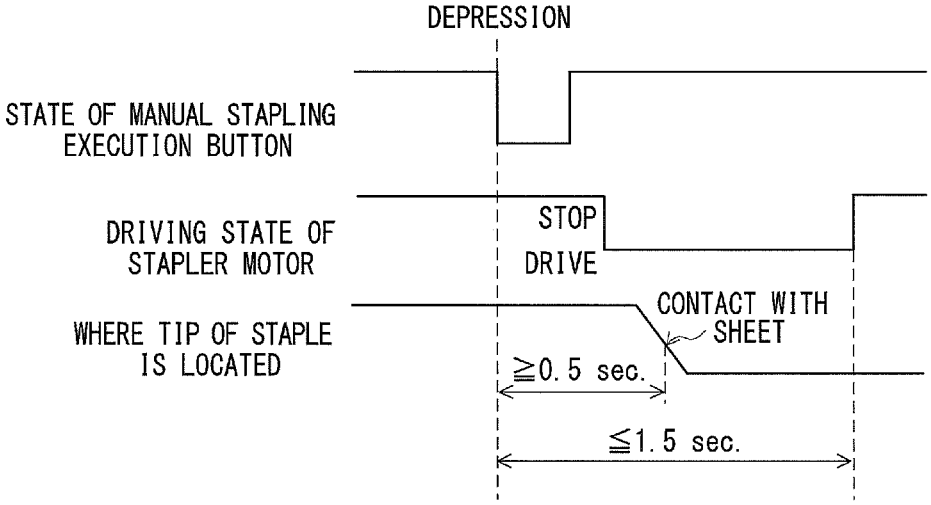
FIG. 6A is an explanatory diagram of error notification.
FIG. 6B is an explanatory diagram of error notification.
FIG. 7 is a time chart when the manual stapling is performed.

After the start of the drive of the stapler motor 163, in a case where the manual stapling sheet sensor 54 detects the non-existence of the sheet bundle (S109: N), the CPU 162 checks the count value T of the counter 180 (S113). If the count value T is more than or equal to the setup time (in this embodiment, "0.5 seconds") (S113: Y), the CPU 162 notifies an error to the display section 118 while continuing the binding process through the manual stapling (S114). At step S114, the binding member such as the metal staple may remain in the sheet binding processing apparatus 50, therefore, the CPU 162 notifies an error for a request to remove the metal staple, as shown in FIG. 6A.

The fact of detecting the non-existence of the sheet bundle at step S109 means that the sheet bundle once inserted through the manual stapling sheet insertion port 53 has exhausted for some reasons. The "setup time", which will be described later, is the value determined based on the period between the depression of the manual stapling execution button 55 and a contact of the tip of the binding member such as the metal staple with the sheet S2. Therefore, if the count value T is more than or equal to the setup time, it means that the tip of the metal staple has been halfway pushed into the sheet bundle. If the binding process is interrupted in this state, it becomes impossible to take out the sheet bundle from the manual stapling sheet insertion port 53. Therefore, in this case, the binding process is continued while notifying an error.

Since this process is an abnormal process as a binding process through the manual stapling, the metal staple may remain in the sheet binding processing apparatus 50. The remaining metal staple may be pushed into the sheet binding processing apparatus 50 along with the sheets S2 at the next binding process through the manual stapling, which may cause a failure of the sheet binding processing apparatus 50. Therefore, by notifying the error to prompt the removal of the metal staple to the user, the failure of the sheet binding processing apparatus 50 caused by the remaining metal staple is prevented.

If the count value T is less than the setup time (0.5 seconds) (S113: N), the CPU 162 immediately stops the drive of the stapler motor 163 without completing the binding process (S115). After stopping the stapler motor 163, the CPU 162 displays the error message on the display section 181 as shown in FIG. 6B informing the user of the incompletion of the binding process (S116). Then, the CPU 162 changes the detection time interval t1 to 1 second and ends the binding process through the manual stapling (S112).

If the count value T is less than the setup time, the tip of the metal staple is not contacted with the sheet bundle. Therefore, by stopping the drive of the stapler motor 163 at this stage, the binding process is stopped, which prevents the metal staple from remaining in the sheet binding processing apparatus 50.

As above, even in a situation where, after giving the permission to perform the binding process through the manual stapling, the sheet bundle in the manual stapling sheet insertion port 53 has exhausted, the CPU 162 stops the binding process or notifies the execution of the binding process under the non-existence of the sheet bundle. This enables the user to find that the binding process has not been performed or the binding member has remained in the sheet binding processing apparatus 50. User's removal of the remaining binding member enables to prevent the breakdown of the sheet binding processing apparatus 50.

Description is made with regard to the "setup time" in the process of step S113. FIG. 7 is a time chart illustrating the timing after the depression of the manual stapling execution button 55 to the stop of the drive of the stapler motor 163.

When the manual stapling execution button 55 is depressed, the stapler motor 163 is driven. Once the stapler motor 163 is driven, the binding process is started and the tip of the binding member such as the metal staple contacts with the sheet bundle. In this embodiment, the time taken from the depression of the manual stapling execution button 55 to the contact of the tip of the metal staple with the sheet bundle is assumed to be "more than or equal to 0.5 seconds". Based on this, the setup time of step S113 is set to "0.5 seconds". Then, the time taken to stop the drive of the stapler motor 163 is assumed to be "less than or equal to 1.5 seconds". The setup time depends on product specifications of the sheet binding processing apparatus 50.

If the binding process is stopped in the middle of the process, the sheet bundle stops with the metal staple halfway pushed into the sheet bundle, which makes it impossible for the user to take out the sheet S2 thereafter. Therefore, in a case where the stapler metal is contacted with the sheets S2 (in a case where the time has elapsed over the setup time), the binding process is continued while notifying the error (S114).

As above, monitoring of the existence or non-existence of the sheet bundle in the sheet binding processing apparatus 50 is continued. If non-existence of the sheet bundle is detected even in the middle of the binding process, the CPU 162 stops the binding process and notifies the user of the stop of the binding process. User's removal of the binding member in response to the notification enables to reduce possibility of breakdown of the sheet binding processing apparatus 50.

Figure 8:
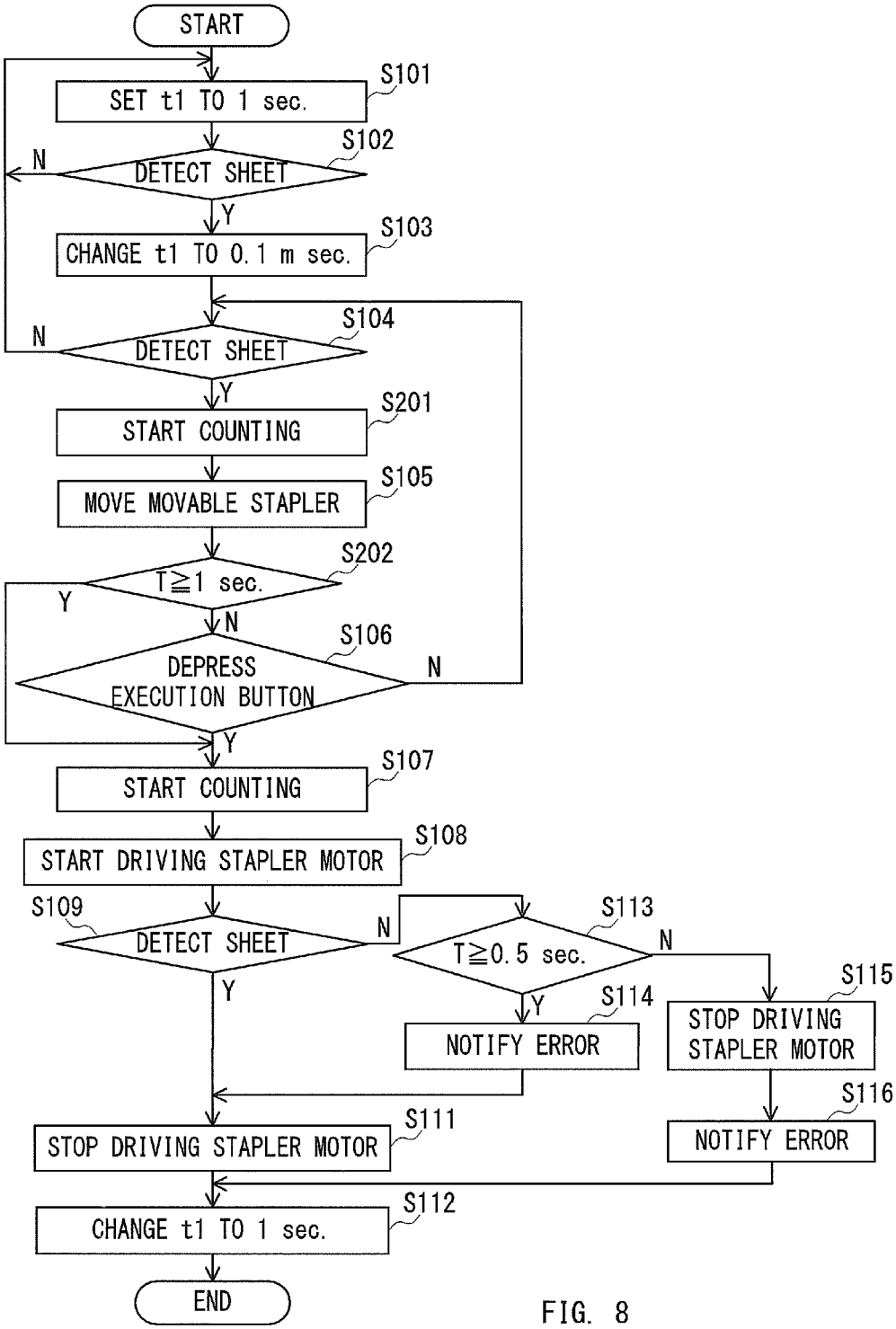
FIG. 8 is a flowchart illustrating a modification of the flowchart as illustrated in FIG. 5.

In the process of FIG. 5 as above, when the manual stapling execution button 55 is depressed, the CPU 162 starts to drive the staple motor 163. Triggered not only by the depression of the manual stapling execution button 55, the CPU 162 may automatically start the drive of the stapler motor 163 after the elapse of a certain period of time after the detection of the sheet bundle by the manual stapling sheet sensor 54. FIG. 8 shows a flowchart of the procedures executed by the CPU 162 in this case.

In the flowchart of FIG. 8, procedures of step S201 and step S202 are added into the processing as shown in FIG. 5. Other procedures are similar to those as described with regard to the processing as shown in FIG. 5. Therefore, the description thereof is omitted. When the manual stapling sheet sensor 54 detects the existence of the sheet bundle at step S104, the CPU 162 resets the counter T and starts counting (S201).

After the start of the drive of the stapler movement motor 164 at step S105, the CPU 162 determines whether or not the count value of the counter T has become more than or equal to 1 second (S202). Note that the "1 second" at step S202 is one example so that the other time may be set. If it is determined that the value of the counter T has not become more than or equal to 1 second (S202: N), the CPU 162 executes the above-mentioned processing of step S106. If the counter value of the counter T has become more than or equal to 1 second (S202: Y), the CPU 162 executes the above-mentioned processing of step S107. It means that if no removal of the sheet bundle from the manual stapling sheet insertion port 53 is detected for 1 second after the detection of the sheet bundle at step S104, the procedures after the step S107 as mentioned above are performed even the manual stapling execution button 55 is not depressed.

Note that, in addition to being installed inside the image forming apparatus 1, the sheet binding processing apparatus 50 may be stand-alone type apparatus, which is provided and used in conjunction with the image forming apparatus 1. Further, the sheet binding processing apparatus 50 may be mounted on the image forming apparatus 1 itself.

The manual stapling sheet sensor 54 may be any type of the sensor such as transmission-type sensor, reflection-type sensor, flag-type sensor, as long as the existence or non-existence of the sheet S2 is detectable.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of priority from Japanese Patent Application No. 2013-099202, filed May 9, 2013, which is hereby incorporated by reference herein in its entirety.

What is claimed is:

1. A sheet binding processing apparatus comprising:

a sheet insertion port through which a sheet bundle formed of a plurality of sheets is inserted;

a binding unit configured to bind the sheet bundle inserted through the sheet insertion port;

a detection unit configured to detect, at a predetermined detection time interval, an existence or non-existence of the sheet bundle in the sheet insertion port; and a control unit configured to stop, in a case where the non-existence of the sheet bundle is detected by the detection unit after the detection of the existence of the sheet bundle by the detection unit and before the binding of the sheet bundle by the binding unit, the operation of the binding unit without completing the binding process performed by the binding unit.

2. The sheet binding processing apparatus according to claim 1, wherein the control unit changes a detection time interval applied after the detection of the existence of the sheet bundle by the detection unit to be less than the predetermined detection time interval set before the detection of the existence of the sheet bundle.

3. The sheet binding processing apparatus according to claim 1, further comprising a counter configured to measure time after start of an operation by the binding unit, wherein the control unit is configured, in a case where the non-existence of the sheet bundle is detected after the start of the operation by the binding unit and before the binding process to the sheet bundle is completed, to stop the operation of the binding unit without completing the binding process if the time measured by the counter is less than a setup time, and to continue the operation of the binding unit if the time measured by the counter is more than or equal to the setup time.

4. The sheet binding processing apparatus according to claim 3, further comprising an instruction unit which validates operation after the detection of the sheet bundle by the detection unit and manually inputs an execution instruction to the control unit to execute the binding process to the sheet bundle;

wherein the control unit is configured to start the operation of the binding unit when the execution instruction is input by the instruction unit.

5. The sheet binding processing apparatus according to claim 3, wherein the setup time is determined based on the period between the input of the execution instruction and a contact of a tip of the binding member for binding the sheet bundle with the sheet bundle.

6. The sheet binding processing apparatus according to claim 3, further comprising a display section configured to display information;

wherein the control unit is configured to display a message on the display section requesting to remove the binding member for binding the sheet bundle if the time measured by the counter is more than or equal to the setup time.

7. The sheet binding processing apparatus according to claim 3, further comprising a display section configured to display information;

wherein the control unit is configured to display a message on the display section indicating that the binding process has stopped if the time measured by the counter is less than the setup time.

8. The sheet binding processing apparatus according to claim 1, wherein an abutment member is provided to the sheet insertion port, the abutment member being for positioning the inserted sheet bundle, and wherein the detection unit is arranged at equal distance from two sides perpendicular to the sheet bundle with the sheet bundle inserted through the sheet insertion port positioned by the abutment member.

9. An image forming system comprising:

an image forming unit configured to form an image on a sheet;

a sheet insertion port through which a sheet bundle formed of a plurality of sheets is inserted;

a binding unit configured to bind the sheet bundle inserted through the sheet insertion port;

a detection unit configured to detect, at a predetermined detection time interval, an existence or non-existence of the sheet bundle in the sheet insertion port; and a control unit configured to stop, in a case where the non-existence of the sheet bundle is detected by the detection unit after the detection of the existence of the sheet bundle by the detection unit and before the binding of the sheet bundle by the binding unit, the operation of the binding unit without completing the binding process performed by the binding unit.

10. The image forming system according to claim 9, wherein the control unit changes a detection time interval applied after the detection of the existence of the sheet bundle by the detection unit to be less than the predetermined detection time interval set before the detection of the existence of the sheet bundle.

11. The image forming system according to claim 9, further comprising a counter configured to measure time after start of an operation by the binding unit;

wherein the control unit is configured, in a case where the non-existence of the sheet bundle is detected after the start of the operation by the binding unit and before the binding process to the sheet bundle is completed, to stop the operation of the binding unit without completing the binding process if the time measured by the counter is less than a setup time, and to continue the operation of the binding unit if the time measured by the counter is more than or equal to the setup time.

12. The image forming system according to claim 11, further comprising an instruction unit which validates operation after the detection of the sheet bundle by the detection unit and manually inputs an execution instruction to the control unit to execute the binding process to the sheet bundle;

wherein the control unit is configured to start the operation of the binding unit when the execution instruction is input by the instruction unit.

13. The image forming system according to claim 11, wherein the setup time is determined based on the period between the input of the execution instruction and a contact of a tip of the binding member for binding the sheet bundle with the sheet bundle.

14. The image forming system according to claim 11, further comprising a display section configured to display information;

wherein the control unit is configured to display a message on the display section requesting to remove the binding member for binding the sheet bundle if the time measured by the counter is more than or equal to the setup time.

15. The image forming system according to claim 11, further comprising a display section configured to displaying information, wherein the control unit is configured to display message on the display section indicating that the binding process has stopped if the time measured by the counter is less than the setup time.

16. The image forming system according to claim 9, wherein an abutment member is provided to the sheet insertion port, the abutment member being for positioning the inserted sheet bundle, and wherein the detection unit is arranged at equal distance from two sides perpendicular to the sheet bundle with the sheet bundle inserted through the sheet insertion port positioned by the abutment member.

* * * * *